US005303426A

United States Patent [19]

Jones

[11] Patent Number: 5,303,426

[45] Date of Patent: Apr. 19, 1994

[54] SWEATBAND - EARPHONE SYSTEM

[75] Inventor: Christopher L. Jones, Hollywood, Fla.

[73] Assignee: Marvelous Creations, Inc., Jackson, Mich.

[21] Appl. No.: 48,294

[22] Filed: Apr. 19, 1993

[51] Int. Cl.[5] ..... A42C 5/00

[52] U.S. Cl. ..... 2/181; 2/209; 2/209.13; 2/906; 2/DIG. 11

[58] Field of Search ..... 2/6, 171, 172, 181, 2/185 R, 196, 199, 208, 209, 209.1, 423, DIG. 11; 128/210.19, 864, 865, 866, 867; 379/430; 381/183, 187; 455/100, 351

[56] References Cited

U.S. PATENT DOCUMENTS 4,109,105 8/1978 Von Statten, Jr. ..... 179/1 VE
4,669,129 6/1987 Chance ..... 2/209
4,727,599 2/1988 Rappaport et al. ..... 455/351
4,776,044 10/1988 Makins ..... 2/199
4,858,248 8/1989 Goldsmith ..... 2/199
4,918,757 4/1990 Janssen ..... 2/171
5,038,412 8/1991 Cionni ..... 2/181
5,117,510 6/1992 Broussard ..... 2/DIG. 11
5,119,513 6/1992 McKay ..... 2/DIG. 11

*Primary Examiner*—Clifford D. Crowder
*Assistant Examiner*—Diana L. Biefeld
*Attorney, Agent, or Firm*—Beaman & Beaman

[57] ABSTRACT

A sweatband and earphone system utilizing a head sweatband preferably formed of an elastic fabric having internal pockets defined therein for receiving earphones connected to a radio or tape player. The sweatband comfortably and securely maintains the earphones upon the wearer's ears, and the sweatband includes stretchable openings permitting the earphones to be readily inserted and removed.

6 Claims, 1 Drawing Sheet

SWEATBAND - EARPHONE SYSTEM

BACKGROUND OF THE INVENTION

1. Field of the Invention

The invention pertains to head sweatbands of ten worn by athletes during exercise to absorb moisture wherein the sweatband also serves to support and position earphones adjacent the wearer's ears.

2. Description of the Related Art

Athletes often wear moisture absorbent headbands during exercising to hold the hair in place, and absorb perspiration. Such sweatbands are usually formed of elastic fabric, such as terry cloth, and because of the elasticity of the fabric the sweatbands readily accommodate themselves to a wide variety of head sizes.

It is also very common for those exercising, particularly when walking, jogging and running, to wear small earphones connected to a belt mounted radio or tape player for entertainment or study purposes during exercising. Such earphones are usually small and lightweight, and normally a pair of earphones are connected by a resilient bridge spanning the head for biasing the earphones against the ears. During most exercising, the earphone wearer's head is subjected to movement, vibration and jarring, such as occurs during jogging and running, or other actions producing head movement, and it is often necessary to adjust the earphones such that relatively strong biasing forces are imposed on the earphones to keep them properly oriented to the ears during exercising. Such earphone pressures often produce discomfort, and many have found that the problems of wearing earphones during exercising has substantially detracted from the pleasures obtained by their use.

OBJECTS OF THE INVENTION

It is an object of the invention to combine a head sweatband with earphones to permit both components to function in their normal manner, and wherein the sweatband provides the support and positioning of the earphones to the wearer's ears.

A further object of the invention is to provide a combination sweatband and earphone system wherein earphones are located within a sweatband formed of an elastic fabric whereby the elastic character of the sweatband maintains the earphones in the proper relationship to the wearer's ears.

An additional object of the invention is to provide a sweatband and earphone system wherein a sweatband formed of an elastic fabric supports earphones within the sweatband, and the earphones may be readily inserted into the sweatband, or removed therefrom, permitting the sweatband to be readily cleaned in the normal manner.

An additional object of the invention is to provide a sweatband and earphone system wherein earphones are located within an elastic fabric sweatband and the sweatband includes internal pockets for receiving the earphones and maintaining the earphones securely within the pockets during use.

SUMMARY OF THE INVENTION

In the practice of the invention, an annular sweatband formed of an elastic tubular fabric is used to support small earphones within the confines of the sweatband. The sweatband is tubular in cross section forming an internal chamber, and within the chamber pockets are defined by forming openings in the outer side of the sweatband at opposed locations approximating the locations of the wearer's ears when the sweatband is worn.

The openings formed in the sweatband constitute elongated slits of a length normally less than the maximum dimension of the earphones to be located within the sweatband. However, because of the elastic nature of the sweatband fabric the openings may be stretched to accommodate the earphone maximum dimension permitting the earphones to be easily inserted into the sweatband pockets, or removed therefrom for washing purposes.

The openings formed in the outer sides of the sweatband are located above the lower regions of the internal chamber forming a pocket for supporting the earphone weight within the sweatband, and the presence of this pocket eliminates the likelihood of the earphone inadvertently passing through the opening.

The earphones are loosely located within the sweatband so as not to interfere with the stretching of the fabric, and the sweatband permits the earphones to be comfortably located adjacent the wearer's ears, even during extensive head movement.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
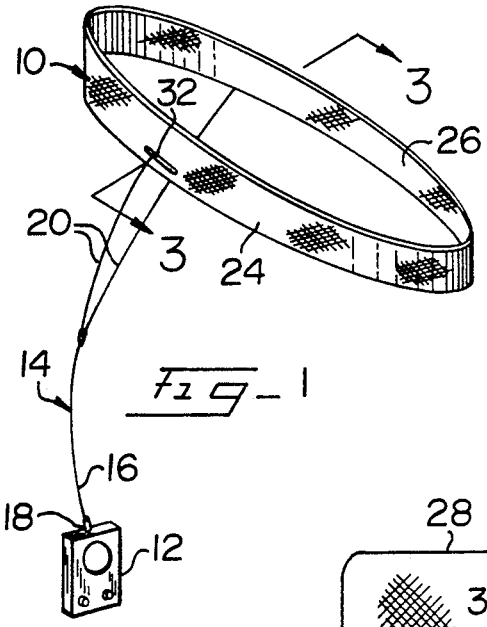
FIG. 1 is a perspective view of a complete sweatband and earphone system in accord with the invention.
Figure 4:
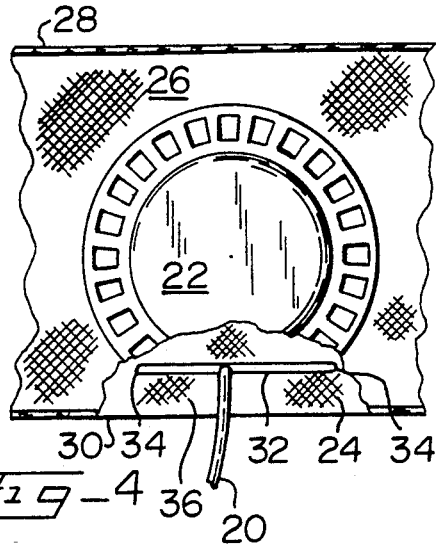
FIG. 4 is an enlarged elevational partially sectional view taken through the sweatband illustrating the earphone in place.
Figure 2:
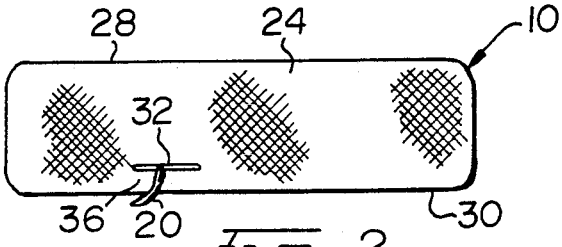
FIG. 2 is a side elevational view of the sweatband.
Figure 3:
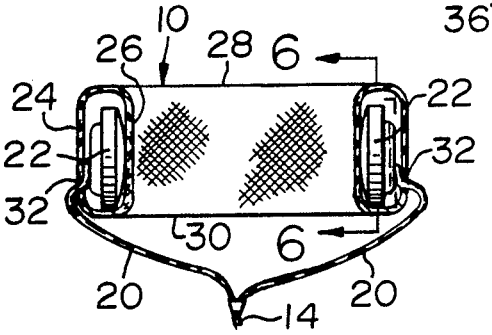
FIG. 3 is an elevational section view taken along Section 3—3 of FIG. 1.
Figure 6:
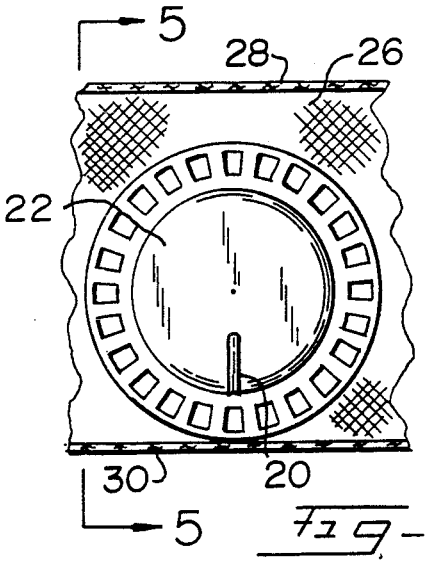
FIG. 6 is an elevational sectional view as taken along staggered Section 6—6 of FIG. 3.

As illustrated in FIG. 1, a sweatband is shown at 10, preferably constituting an annular body formed of an elastic terry cloth fabric, as is well known. A radio or tape player is illustrated at 12, and the conductor wire system between the radio and sweatband is generally indicated at 14. The conductor system includes the wire 16 which is removably plugged into the radio 12 by jack 18, and the wire 16 is divided into separate earphone wires 20, each wire 20 being connected to an earphone 22 located within the sweatband 10. As is well known, the radio or tape player 12 is usually capable of producing a stereophonic output, and the earphone wires 20 and earphones 22 are connected to the stereo output of the radio 12.

As indicated above, the usual construction of the sweatband 10 is of a moisture absorbent, flexible elasticized fabric, such as terry cloth. Usually, the sweatband is of a tubular cross section, and it is to be appreciated that the sweatband 10 can be formed in a variety of constructions, but is preferably of an elastic soft character as to readily adapt to the size of the wearer's head.

The sweatband includes an outer side 24, an inner side 26, a top 28, and a bottom 30. As the sweatband is of a tubular configuration, an internal chamber 31 is defined within the sweatband as will be appreciated from FIG. 5.

A pair of elongated openings 32 are formed in the outer side 24 in order to permit the earphones 22 to be removably located within the sweatband chamber 31. As will be appreciated from the drawings, the openings 32 are substantially parallel to the bottom 30, and are vertically spaced above the bottom 30. The ends of the openings 32 are represented at 34.

Figure 5:
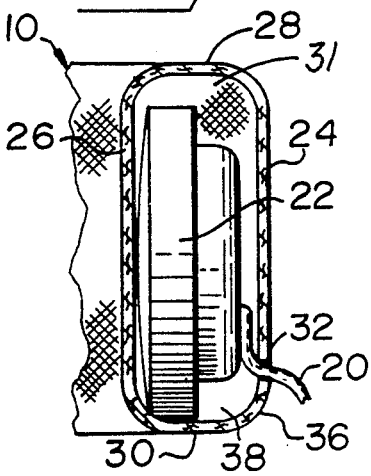
FIG. 5 is an elevational sectional view as taken along Section 5—5 of FIG. 6, the opening being illustrated.

Because the openings 32 are vertically located above the bottom 30, an upwardly extending sweatband portion 36 exists between the bottom 30 and the adjacent opening 32, and the portion 36 defines a pocket 38 in which the earphones 22 rest, FIG. 5.

The normal dimension between the opening ends 34 of a common opening 32 are less than the maximum dimension of an earphone 22, i.e. the earphone diameter, but because the fabric of the sweatband body is elastic, the openings 32 can be expanded to separate the slot ends and permit an earphone 22 to be inserted through an opening 32. After insertion of the earphone through the opening, the opening 32 will then contract to its normal dimension preventing the earphone from escaping the chamber 31 and pocket 38.

Additionally, the earphones 22 are retained within the sweatband chamber 31 due to the configuration of the pocket 38 as defined by the portion 36. The pocket 38 forms a "cup" supporting the earphone within the sweatband, and the likelihood of the earphone inadvertently separating from the sweatband is very small as the earphone must be lifted from the pocket 38 and forced through the opening 32.

The openings 32, and the earphones 22, are located within the sweatband such that upon the wearer placing the sweatband upon the head the earphones will be located upon the ears. The soft character of the sweatband 10 prevents the earphones from chafing or hurting the ears, and the porosity of the fabric of the sweatband permits the sound to readily pass through the inner surface 26. It will be appreciated that the earphones 22 may be individually adjusted within the chamber 31 and pockets 38 to accommodate ear location with respect to the particular wearer.

As will be appreciated from the above description, the sweatband and earphone system described is readily worn without requiring unusual skills. The sweatband 10 will be placed upon the head at that location which fulfills the functions of a sweatband or headband, and by placing the sweatband over the ears the earphones 22 will be positioned on the ears for optimum hearing capabilities. The elastic character of the sweatband 10 will maintain the sweatband firmly upon the wearer's head and the earphones 22 on the ears even during jogging, running, walking and other exercises wherein head movement occurs.

When it is desired to wash or clean the sweatband 10, the earphones 22 may be readily pushed or pulled from the openings 32, and the headband cleaned in the normal manner. Reversing the process, the earphones 22 may be readily inserted into the chamber 31 and pocket 38 through the openings 32 causing the openings to temporarily expand to accommodate the earphone diameter.

It is appreciated that various modifications to the inventive concepts may be apparent to those skilled in the art without departing from the spirit and scope of the invention.

I claim:

1. In combination, a headband comprising an annular flexible body at least partially formed of an elastic moisture absorbing fabric adapted to encircle the wearer's head and ears, a chamber defined within said body, an elongated opening defined within said body intersecting and providing access to said chamber, and an earphone within said chamber, said earphone being removably insertable into said chamber through said opening, said headband body maintaining said earphone adjacent the wearer's ear, said body being entirely formed of a tubular sheath of elastic fabric, the interior of said sheath defining said chamber, said earphone having a maximum dimension, said elongated opening defined within said sheath having a normal length less than said maximum dimension, the length of said opening being resiliently expandable to a dimension equal or greater than said maximum dimension whereby said earphone may be removably inserted into the interior of said sheath.

2. In a combination as in claim 1, said sheath interior chamber having a lower region and sides, said opening being defined in a side spaced above said lower region whereby a pocket is defined within said sheath chamber, said earphone being located within said pocket.

3. A sweatband earphone system comprising, in combination, an annular flexible headband having a body primarily formed of a moisture absorbent elastic fabric and having opposed side regions each defined by inner and outer sides, a top and a bottom, a chamber defined within said body at said side regions, and an earphone located within said chamber, said headband maintaining said earphone adjacent the wearer's ear, at least one elongated opening defined within one of said body region sides intersecting said chamber, said earphone being removably insertable into said chamber through said opening, said earphone having a maximum dimension, said opening being formed in said elastic fabric and having a normal length less than said earphone maximum dimension, the length of said opening being resiliently expandable to a dimension equal or greater than said earphone maximum dimension to permit movement of said earphone therethrough.

4. In a sweatband earphone system as in claim 3, an opening defined within each opposed side region and a pair of earphones within said chamber, an earphone being located within each side region adjacent an opening.

5. In a sweatband earphone system as in claim 4, said openings being defined in said body outer side.

6. In a sweatband earphone system as in claim 4, said chamber having a lower region adjacent said body bottom, said openings being defined in the associated side region outer side above said lower region whereby pockets are defined in said chamber, each earphone being located within a pocket.

* * * * *